United States Patent [19]

Schreiber et al.

[11] Patent Number: 4,763,807

[45] Date of Patent: Aug. 16, 1988

[54] SHEET METAL BLANK FOR PRODUCING THE BODY OF CANS

[75] Inventors: Peter Schreiber, Ipsach; Gianni Padovan, Dombresson, both of Switzerland

[73] Assignee: Fael S.A., St. Blaise, Switzerland

[21] Appl. No.: 925,385

[22] Filed: Oct. 31, 1986

[30] Foreign Application Priority Data

Nov. 4, 1985 [CH] Switzerland ..... 4728/85
Nov. 4, 1985 [CH] Switzerland ..... 4729/85

[51] Int. Cl.[4] ..... B65D 17/36
[52] U.S. Cl. ..... 220/274; 220/276
[58] Field of Search ..... 220/274, 275, 276; 413/12, 14, 15, 16, 17, 54, 55, 66, 67, 68, 72, 74, 77

[56] References Cited

U.S. PATENT DOCUMENTS

| | | | |
|---|---|---|---|
| 829,036 | 8/1906 | Ryan | 220/274 |
| 2,004,104 | 6/1935 | Erb | 220/275 |
| 2,159,325 | 5/1939 | Fabrice | 413/12 |
| 2,536,044 | 1/1951 | Erb | 413/12 |
| 3,838,787 | 10/1974 | McCloskey | 220/276 |
| 4,637,521 | 1/1987 | Opprecht et al. | 220/276 |

*Primary Examiner*—Frederick R. Schmidt
*Assistant Examiner*—Robert Showalter
*Attorney, Agent, or Firm*—Watson, Cole, Grindle & Watson

[57] ABSTRACT

A can body made of a sheet metal blank has a tear strip extending between opposite ends of the blank and into a tongue extending from one blank edge. An overlapping portion at overlapping ends of the blank is completely welded, and the tongue width is greater than the strip width to assure tendency of rupture of the can body from opposite side edges of the tongue toward the strip to avoid premature breaking of the strip.

1 Claim, 2 Drawing Sheets

SHEET METAL BLANK FOR PRODUCING THE BODY OF CANS

BACKGROUND OF THE INVENTION

1. Field of the Invention

The present invention relates generally to the production of sheet metal cans. It relates further to a sheet metal blank intended for the production of a sheet metal body of a sheet metal can, which sheet metal body is made by a welding of a lateral calender or lap seam, and which sheet metal body is provided with a tear strip extending circumferentially thereof between two substantially parallel pre-scored rupture-or score lines and having a starting end in the shape of a tongue extending beyond the weld seam.

One of the problems of sheet metal cans which are manufactured from sheet metal bodies of the kind mentioned above resides in the placing of a tear strip which can be easily and safely opened by a key in spite of the lateral welding seam.

2. Description of the Prior Art

Presently known designs, in which the tongue which forms the starting end of the tear strip has the same width as the tear strip extending between the two score lines, exhibit time and again the danger that after welding the seam (by a mechanical destruction thereof) the actual rupture lines do not proceed along the score lines, and that rather at least one of the two actual rupture lines proceed away from the pre-scored lines. Such unwanted rupture or tear lines usually proceed angularly inwardly toward the second score line or towards the second unwanted tear line. Quite obviously such leads to a premature destruction of the tear strips and a further opening of the sheet metal can is not possible without the aid of an additional tool.

SUMMARY OF THE INVENTION

It is, therefore, a general object of the present invention to provide a sheet metal blank including a tear-off strip which may be satisfactorily and properly torn across the welded side seam.

A further object is to provide a sheet metal blank for the production sheet metal cans including a tongue which at least adjacent of the side weld seam has be made features a width exceeding the width of the remainder of the tear strip and in which the pre-scored lines extend into the tongue.

Such design of the sheet metal blank allows an impeccable welding remote from the general location of the tongue during the production of the sheet metal body by means of a lateral calender or overlap seam at a high homogenity of the welding material. In the area of the tongue or tear-off strip a cold weld is produced because the transfer resistance is increased at this location due to the increased contact area. The forming of this cold weld allows a problem-free opening of the cans.

A safe execution of the welding at the area of the tongue can be carried out by means of a suitable welding program (increased electrical current during a limited time span, i.e. at the area of the tongue).

Due to the score lines which are located in the widened tongue and which extend practically rectiliniarly through the weld seam, the actual tear lines will initially likewise proceed inwardly but terminate, however, at the pre-scored design rupture or score lines.

An especially preferred embodiment of the inventive sheet metal blank includes a score line located at the end of the tear strip or corresponding sheet metal blank located opposite the tongue, which score line extends transversely or laterally between the pre-scored rupture lines.

Preferably, this transverse score line is located at that side of the sheet metal blank which forms the outer surface of the sheet metal body.

This measure which could actually solve the general object of the invention in itself, is however vastly improved by the above disclosed design of the sheet metal blank, in which the tear lines defining the tear strip extend into the tongue.

This transverse score line is, thereby, located preferably at such a distance from the adjacent edge of the sheet-metal blank extending substantially parallel thereto, which is at least as large as the overlap of the two edges of the sheet metal blank to be welded together.

The transverse score line being located immediately adjacent the weld seam prevents the tongue from completely lying against the sheet metal wall located therebelow and accordingly only a change of the welding parameters in this area is required.

This guarantees an extensive homogenity of the entire weld seam.

Adjacent the transverse score line a high welding pressure must be applied for a sealed welding, which again leads to a very homogeneous material in the rupturing area. Due to the pressure of the transverse score line forming a starting opening also such extremely homogeneous weld seam can be torn without any difficulties which assures that the rupture after the weld seam proceeds along the rupture-or score lines which define the tear-off strip.

BRIEF DESCRIPTION OF THE DRAWINGS

The invention will be better understood and objects after than those set forth above, will become apparent when consideration is given to the following detailed description thereof. Such description makes reference to the annexed drawings wherein.

DESCRIPTION OF THE PREFERRED EMBODIMENTS

Figure 1:
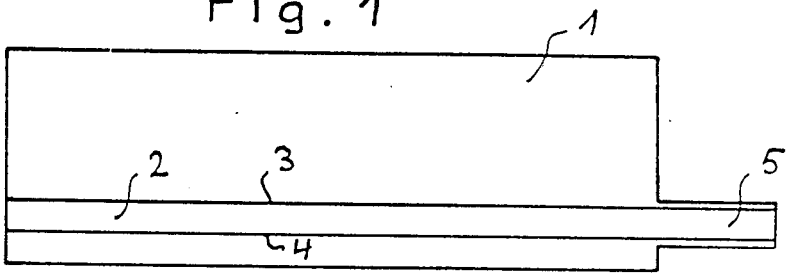
FIG. 1 illustrates a top view of a sheet metal blank designed in accordance with the present invention.

FIG. 1 of the drawings illustrates a sheet metal blank 1 designed in accordance with the invention and which is provided with two parallel lines 3, 4 of weakening which extend along the complete width of the blank and define therebetween a tear-off strip 2. Lines 3, 4 may comprise a pair of spaced scored lines capable of being ruptured. Such score lines have preferably a V-shaped cross-section and their largest depth is located approximately at the center of the wall thickness of the sheet metal (depending on the thickness of the sheet metal). For allowing a tearing-off of the tear-off strip 2 extending between the rupture lines 3, 4, a tongue 5 is provided having a width exceeding the width of the tear-off strip 2. The two pre-scored rupture lines 3, 4 extend completely across the tongue 5. The tongue 5 can be engaged by a suitable (not illustrated) key.

A sheet-metal blank (FIG. 2) produced by a welding of the blank 1 is utilized for producing a can which further comprises a top and a bottom plate (not shown). This can is opened by a (not illustrated) key which is operated to initially engage the tongue 5 so as to thereafter tear off the pre-scored tear-off strip 2 according to the generally known opening procedures.

Figure 2:
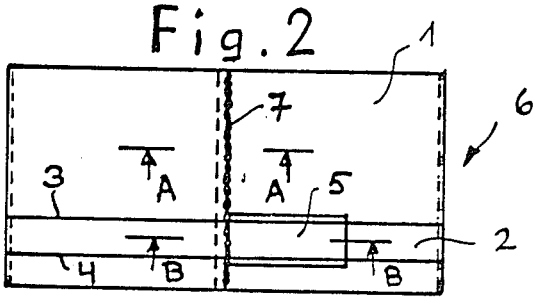
FIG. 2 is a side view of a sheet metal body produced from the blank of FIG. 1.

FIG. 2 illustrates a can body 6 produced from the sheet metal blank 1 by a welding of a laterally located calender or overlap side seam 7. The tongue 5 projects freely beyond the uninterrupted welded side seam 7 (it abuts more or less closely the body surface located therebelow).

Figure 3:
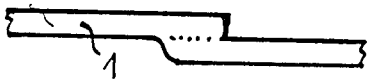
FIG. 3 is a section along line A—A of FIG. 2.
Figure 4:
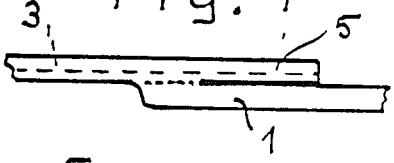
FIG. 4 is a section along line B—B of FIG. 2.

FIGS. 3 and 4 illustrate sections of the wall of the body at the general area of the weld seam 7, whereby FIG. 3 discloses the extremely homogeneous weld at the normal overlap area and whereas FIG. 4 illustrates the same at the area of the tongue 5. A cold weld is generated in this area because the contact resistance increases due to the larger area caused by the tongue 5. Because of the cold weld the can is capable of being subsequently opened without difficulties.

The forming of the cold weld is assured by a suitable welding programme based on which the welding current can be increased at the area of the tongue 5.

Figure 5:
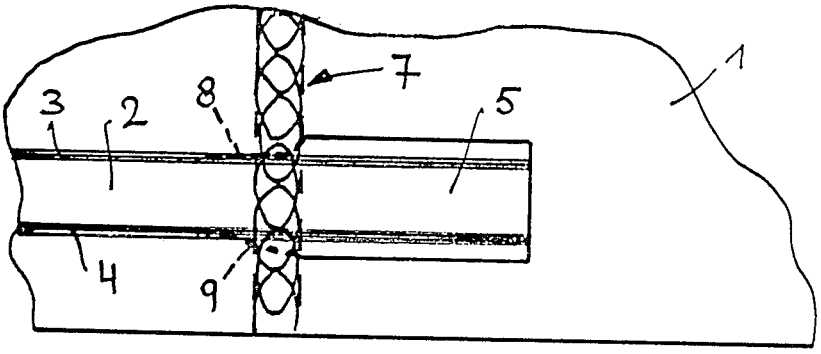
FIG. 5 illustrates on an enlarged scale details of FIG. 2.

FIG. 5 illustrates a part of the body 6 of FIG. 2 on an enlarged scale. It can be seen clearly how the weld seam 7 is broken through or ruptured upon a lifting off of the tongue 5 for opening the can.

The actual rupture lines (shown by interrupted lines) originate at and proceed from the outer free end of the tongue 5, extend inwardly through the weld seam 7 and continues as pre-scored rupture lines 3 and 4.

Cans produced from such sheet metal blanks and having a cold weld area as an opening gap be utilized in the field of technical packing containers, also in the field of foodstuffs.

Figure 6:
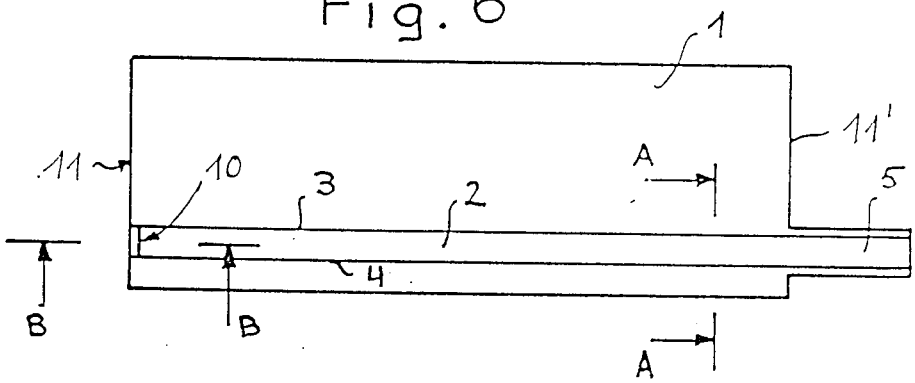
FIG. 6 illustrates a top view of a further embodiment of the invention.

FIG. 6 of the drawing illustrates an alternative of the sheet metal blank according to the invention. Tongue 5 as such could be designed as a direct continuation of the tear-open strip 2, i.e. it could have the same width as the tear-open strip 2 or could be designed somewhat broader such as shown in the illustrated embodiment and due to the above described reasons, such that the pre-scored rupture lines can be lengthened to extend into the tongue. This guarantees that after rupturing through the weld seam the actual rupture lines extend towards the pre-scored rupture lines and, thereafter, follow latter lines precisely without destroying the tear open strip.

In this illustrated embodiment such may be effected by the provision of a transverse score line 10. The score line 10 is located adjacent the end of the tear strip 2 or sheet metal blank edge 11 opposite the tongue 5 and extends between the pre-scored rupture lines 3, 4 at least along the width of the tear strip 2. Preferably it is located at the outer surface of the wall of the body 1.

Figure 7:
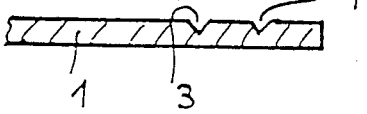
FIG. 7 is a section along line A—A of FIG. 6.
Figure 8:
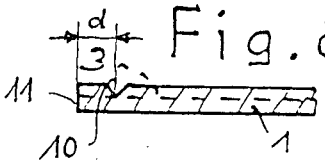
FIG. 8 is a section along line B—B of FIG. 6.

FIGS. 7 and 8 illustrate sections through blank 1 along the illustrated section lines A—A and B—B resp. and show the approximate shapes and dimensions of the scores.

FIG. 8 discloses that the transverse score 10 is located at a distance d from the edge which is for instance 0,2–2 mm larger than the overlap chosen for the welding.

Figure 9:
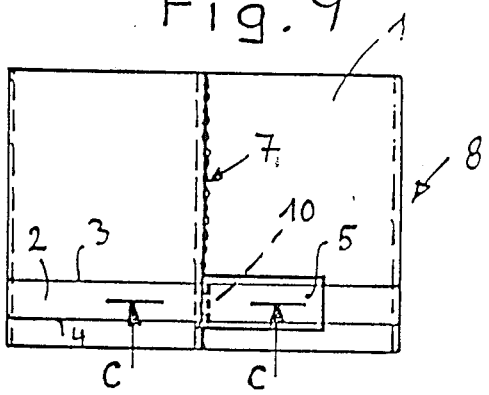
FIG. 9 illustrates a side view of a sheet metal body produced from the blank of FIG. 6.

FIG. 9 illustrates a can body 6 formed from a sheet metal blank 1 by welding a lateral calender or overlap, resp. seam 7. The tongue 5 projects from behind the continuous weld seam 7 (it lies more or less flatly against the body wall 1 located thereunder).

Figure 10:
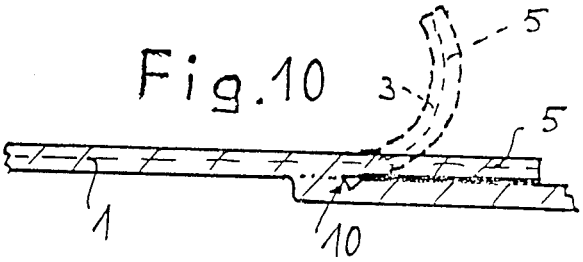
FIG. 10 is a section along line C—C of FIG. 9 on an enlarged scale.

FIG. 10 illustrates, on an enlarged scale, a section along line C—C of FIG. 9. Here it is shown how prior to the homogeneous welding a starting opening for opening a can made therewith is arrived at. Because the tongue can not lie always flatly, only minor changes of the welding parameters relative to the other parts of the seam and accordingly a homogeneous weld seam follows, which is additionally promoted by applying a higher welding pressure (for a tight weld) in this area. Due to the transverse score 10 or the starting opening, resp. formed therewith, the homogeneous welding material can in spite thereof be torn through and the actual rupture lines will run towards the pre-scored rupture lines. This is secured further by the illustrated leading of the design score lines 3, 4 into the tongue 5.

Due to this blank it is possible to produce tight welded cans for any kind of applications, whereby at the same time a safe opening is guaranteed.

While there are shown and described present preferred embodiments of the invention, it is to be distinctly understood that the invention is not limited thereto, but may be otherwise variously embodied and practiced within the scope of the following claims.

What is claimed is:

1. A sheet metal can having a body with overlapping ends defining an overlapping portion at the opposing free edges of said body, said overlapping ends being interconnected by a continuous weldment extending completely between said edges at said overlapping portion, an outer one of said ends having a tongue extending outwardly of said free edge thereof, a tear strip extending from the other of said ends and into said tongue, said strip being delimited by a pair of spaced, rupturable lines, and the width of said tongue at said free edge of said outer end being greater than the spacing between said lines, whereby upon application of an external pulling force to said tongue initial rupturing of said body tends to occur between opposing side edges of said tongue and said lines at said weldment after which removal of said tear strip proceeds without premature breaking of said strip.

* * * * *